US007926754B2

(12) United States Patent
Hoffmann et al.

(10) Patent No.: US 7,926,754 B2
(45) Date of Patent: Apr. 19, 2011

(54) SAFETY SYSTEMS FOR ROLLER MILLS

(75) Inventors: Dirk Hoffmann, Trippstadt (DE); Otto Jung, Huetschenhausen (DE); Karl-Heinz Schuette, Trippstadt (DE)

(73) Assignee: Gebr. Pfeiffer AG, Kaiserslautern (DE)

( * ) Notice: Subject to any disclaimer, the term of this patent is extended or adjusted under 35 U.S.C. 154(b) by 0 days.

(21) Appl. No.: 12/430,380

(22) Filed: Apr. 27, 2009

(65) Prior Publication Data

US 2009/0261190 A1 Oct. 22, 2009

Related U.S. Application Data

(63) Continuation of application No. PCT/EP2007/009016, filed on Oct. 18, 2007.

(30) Foreign Application Priority Data

Oct. 25, 2006 (DE) ..... 10 2006 050 205

(51) Int. Cl.
*B02C 15/00* (2006.01)

(52) U.S. Cl. ..... 241/117

(58) Field of Classification Search ..... 241/117–121, 241/101.2

See application file for complete search history.

(56) References Cited

U.S. PATENT DOCUMENTS

| | | | | |
|---|---|---|---|---|
| 4,887,489 | A | | 12/1989 | Sigg |
| 5,538,192 | A | * | 7/1996 | Parham ..... 241/30 |
| 6,021,968 | A | | 2/2000 | Brundiek et al. |

FOREIGN PATENT DOCUMENTS

| | | | |
|---|---|---|---|
| DE | 153958 | C | 9/1902 |
| DE | 76 20 223 | U | 12/1976 |
| DE | 33 20 037 | C1 | 11/1984 |
| DE | 35 07 913 | A1 | 9/1986 |
| DE | 37 12 562 | C1 | 5/1988 |
| DE | 39 31 116 | A1 | 3/1991 |
| DE | 196 03 655 | A1 | 8/1997 |
| DE | 198 26 324 | C1 | 8/1999 |
| WO | WO 2005/028112 | A1 | 3/2005 |

* cited by examiner

*Primary Examiner* — Mark Rosenbaum
(74) *Attorney, Agent, or Firm* — Muncy, Geissler, Olds & Lowe, PLLC

(57) ABSTRACT

A drive systems for a roller mill is provided. To ensure the continuous availability of the mill, more than two drives are provided, wherein the at least two drives are capable of achieving the full grinding capacity of the roller mill.

18 Claims, 3 Drawing Sheets

SAFETY SYSTEMS FOR ROLLER MILLS

This nonprovisional application is a continuation of International Application No. PCT/EP2007/009016, which was filed on Oct. 18, 2007, and which claims priority to German Patent Application No. 10 2006 050 205.1, which was filed in Germany on Oct. 25, 2006, and which are both herein incorporated by reference.

BACKGROUND OF THE INVENTION

1. Field of the Invention

The invention relates to actively redundant drive systems for roller mills, which comprise a housing, a rotating grinding table with grinding track, grinding rollers that roll on the grinding track, an axial bearing, and a drive having an electric motor and a gear reducer for driving the grinding track.

2. Description of the Background Art

Roller mills have been known for over 100 years, and are used throughout the world. They exist in an extremely wide variety of designs. Thus, for example, DE 153 958 C from 1902 shows a cone mill with a revolving grinding table on which rest eight grinding cones under spring pressure.

Modern mills use grinding rollers that have heavy weights and large diameters to achieve high milling output. Please see DE 198 26 324 C, DE 196 03 655, which corresponds to U.S. Pat. No. 6,021,968, and also EP 0 406 644 B. This type of roller mill has gained extremely wide acceptance in practice because it has considerable advantages with regard to design, control, and energy economy. The chief areas of application for modern roller mills are the cement industry and coal-fired power plants. In the cement industry, roller mills are used for producing raw cement meal as well as for clinker grinding and coal grinding. In combination with rotary kilns and calcining installations, the furnace exhaust gases from the heat exchanger and clinker cooler can be used to dry the grinding stock and pneumatically transport the ground stock. In power plants, the roller mills are used to finely grind the coal and feed it directly into the boiler with the aid of the classifier air, if possible without the use of an intermediate bunker.

It is a matter of course that even modern roller mills are subject to wear resulting from use. The mill must therefore be shut down for maintenance and repair. In recent years, maintenance and repair in the grinding chamber and on the grinding tools have been optimized to such a degree that these tasks can be carried out within a tolerable period of time.

Modern large mills require drive power levels of up to 10 MW. It is a matter of course that the associated bearings and drives, in particular the transmissions, must be of special design. The teeth, the shaft bearings, the integrated axial thrust bearings and their supports within the transmission housing, are particularly heavily loaded. For drive power levels up to 6 MW, planetary bevel gear transmissions, which are matched to the circular grinding table on account of their circular shape, have become established as the prior art; they transmit the static and dynamic grinding forces to the foundation. For example, see DE 35 07 913 A or DE 37 12 562 C, which corresponds to U.S. Pat. No. 4,887,489. Pivoted-pad bearings with hydrodynamic and/or hydrostatic lubrication are used as axial thrust bearings; please see DE 33 20 037 C.

These designs, space-saving in and of themselves, have significant disadvantages, however. As soon as a problem arises with just one component, the entire drive must be dismantled. It has proven to be particularly disadvantageous in this regard that it is not possible to visually inspect the gears of the planetary transmission. This is not possible until the drive has been completely dismantled. Since these drives are special designs, procurement of replacement parts takes a correspondingly long time, i.e., weeks or months, since stocking of replacement parts is considered too cost-intensive on account of the special designs. This is unsatisfactory.

Another disadvantage of the prior art drive design is what is called the maintenance drive, which rotates the grinding table during certain maintenance and repair operations, but which only functions as long as the primary transmission itself functions.

Naturally, there has been no shortage of proposals for doing away with these inadequacies and disadvantages. Thus, DE 39 31 116 C shows a drive device for a roller mill having a grinding table that can rotate about a vertical axis, which has a crown gear connected to the lower part of the grinding table. Moreover, two diagonally arranged drives are provided, each consisting of a drive motor and a gear reducer. Each gear reducer has two pinions that mesh with the crown gear of the grinding table.

Known from DE 76 20 223 U is a roller mill with a ring gear located under its grinding table. The pinions of four hydraulic motors fastened to the base of the mill housing mesh with the ring gear.

Despite the theoretical advantages of these multiple-motor drive concepts, they have been unable to gain acceptance in practice. The reasons for this are the lower efficiency as compared with drives having electric motors and transmissions, and lower availability and service life of the hydraulic components. The dual-drive concept described was unable to gain acceptance because considerable excess torques arise during operation, which can result in overloading of the transmission to the point of destruction. Moreover, it was not possible to support mill operation with the required capacity in the event of the failure of a drive.

SUMMARY OF THE INVENTION

It is therefore an object of the present invention to provide a drive system for roller mills that makes it possible to carry out maintenance and repair operations on the drive without interrupting the overall process.

In an embodiment, an actively redundant drive system is provided, wherein the continuous availability of at least two drives is ensured by the provision of more than two drives, and wherein the at least two drives deliver the required grinding output of the roller mill.

An advantage of the inventive drive system is its increased availability thanks to the ability to continue operating the mill with adequate capacity when one drive fails.

Another advantage is that each drive need only supply a part of the mill drive power. This means that the electric motors and transmissions can be produced as standard components. For the first time, it is possible to stock drives or drive components in an economical manner, so that rapid replacement is possible.

A further exemplary advantage is based on the fact that transmissions with lower outputs can be built with higher reduction ratios than transmissions with higher outputs. This in turn has the consequence that electric motors with high speeds can be used for the drive. Electric motors with high speeds are significantly more compact than electric motors of equal power with low speeds. This permits a further reduction of sizes and weights.

Another advantage is in that small electric motors and small transmissions have smaller moments of inertia and are thus more dynamic than large units. The control system can thus react more quickly to the requirements of the grinding process.

Yet another is the elimination of what is known as the maintenance drive. Its task can be taken over by one of the primary drives.

Also, the arrangement and construction of the transmissions now permits visual inspection without disassembly.

The crown gear with which the pinions of the individual drives mesh can be part of the grinding pan by means of flanging or casting. The teeth can be inside or outside teeth.

It has further been shown to be advantageous for each drive to be equipped with only one, preferably tiltable, pinion. Damaging excess torques such as those that can arise in the concept described in DE 39 31 116 C, are thus ruled out.

The electric motors of the drives can be advantageously powered by frequency converters, with the aid of which speed and torque are controlled.

The frequency converters can be organized using the master/slave principle. This ensures that all drives operate synchronously.

According to an embodiment of the inventive safety system, three or more drives are provided, wherein care is taken to ensure that the radial forces act on the crown gear as symmetrically as possible. In this regard, it is possible to proceed in accordance with the requirements of the space at the site. Moreover, shutdown of drives need not take place solely on account of maintenance or repair operations; instead, it is possible to shut down individual drives when less grinding output is needed.

Standard asynchronous electric motors can be used instead of the slip-ring motors that are customary today. Asynchronous motors are especially simple and robust in construction, and in their two-pole design have the highest output speed and thus the smallest size for equal output.

According to an embodiment of the invention, each drive can be mounted on a carriage. In this way, it is especially easy to activate and deactivate the drive.

The drive motors can be arranged vertically or horizontally. In a vertical arrangement, the bevel gear stage of the transmission is eliminated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
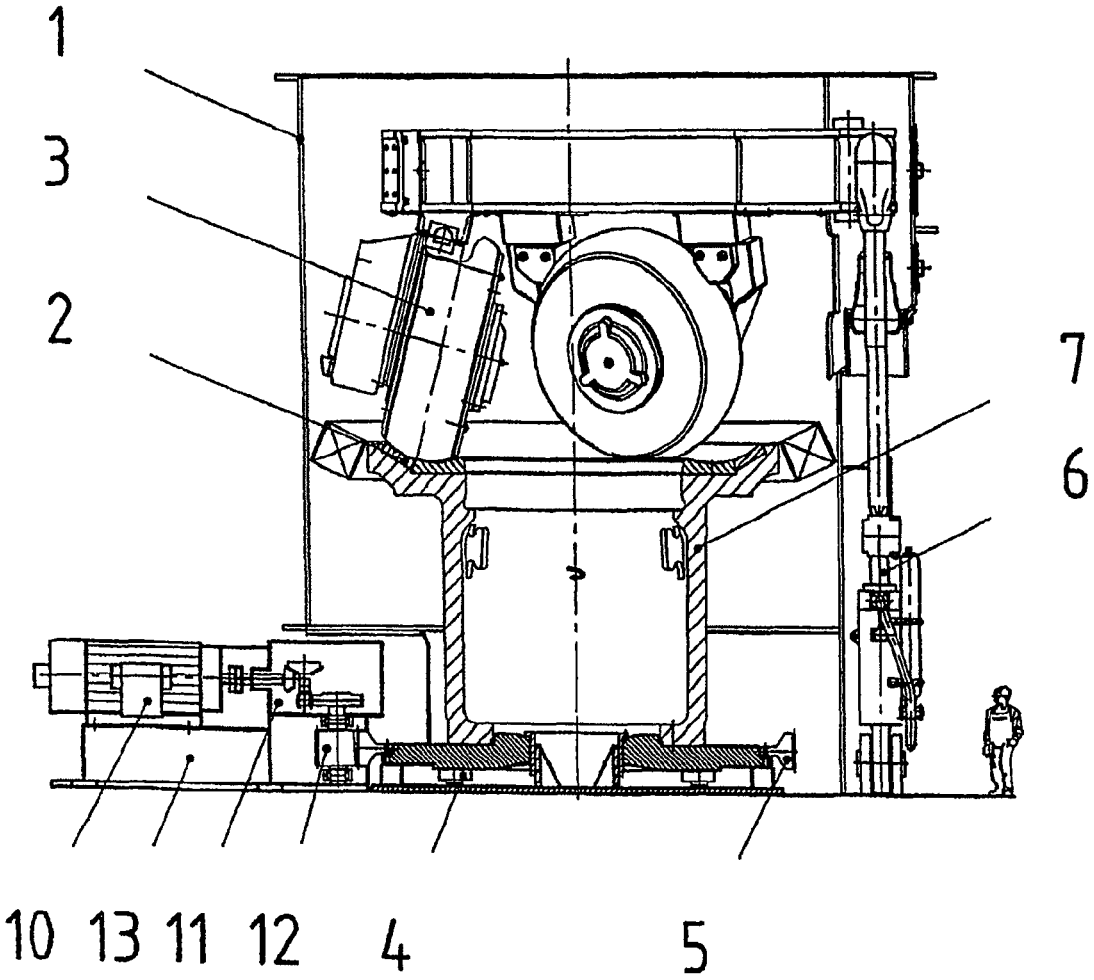
FIG. 1 shows a first example embodiment of a roller mill as a sectional view.
Figure 2:
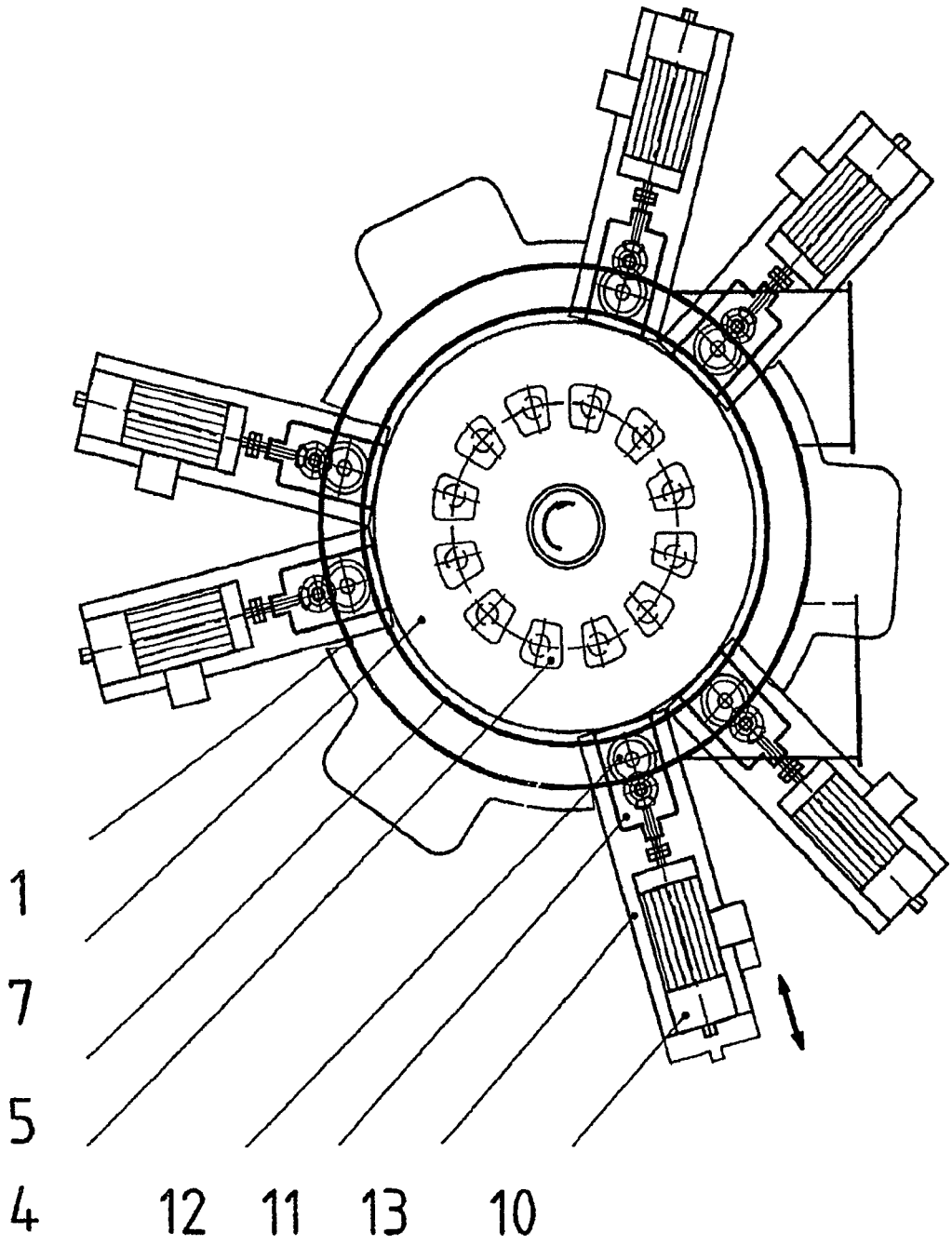
FIG. 2 shows a top view of the roller mill from FIG. 1.

A first roller mill is shown purely schematically in FIG. 1 as a sectional view and in FIG. 2 as a top view. Visible are a housing 1, in which a grinding table 7 with grinding track 2 is rotatably mounted on an axial bearing 4. Rolling on the grinding track 2 are grinding rollers 3 whose surface pressure is produced with the aid of connecting rods 6 with hydraulic clamping cylinders.

A crown gear 5 is mechanically connected to the grinding table 7. The connection can be made by screws or welding. It is also possible to build the crown gear 5 directly onto the grinding table 7.

Multiple drives having electric motors 10 and gear reducers 11 are distributed around the mill housing 1. The transmissions 11 are bevel gear reducers whose output pinions 12, which are preferably self-adjusting, mesh with the crown gear 5.

FIG. 2 shows a top view of six drives having electric motors 10 and bevel gear reducers 11 distributed around the mill housing 1. The electric motors are installed with horizontal axes.

Figure 3:
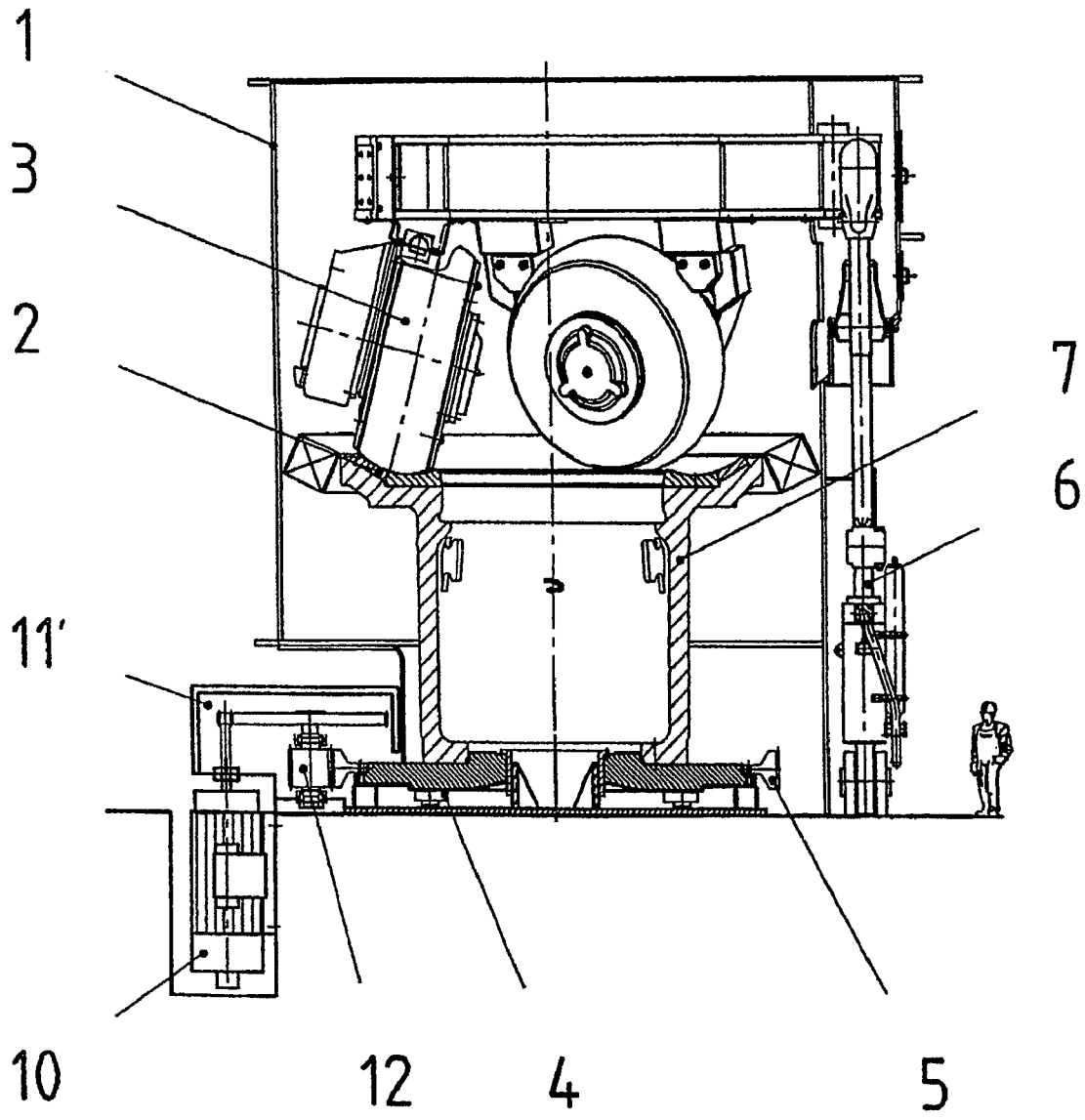
FIG. 3 shows a second example embodiment of a roller mill as a top view.

FIG. 3 shows an alternative example embodiment. Here, the drive motors 10 are installed vertically, so that the bevel gear stage required by the conventional transmissions is eliminated. The transmission 11' is a pure spur gear reducer. The electric motor 10, which is advantageously a standard asynchronous motor preceded by a frequency converter, is installed in a trench in the present example embodiment.

When one drive fails, the remaining drives continue to operate unimpeded, and also deliver the required grinding output. If it is mounted on a carriage 13, the failed drive can be pulled out without interrupting the grinding process. If the drives have fixed mountings, just a brief interruption of the grinding process suffices. During this brief period, ground stock can be taken from an intermediate bunker, so that the overall process, e.g. the production of cement in a rotary kiln or the feeding of a power plant with powdered coal, need not be interrupted.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A redundant drive system for roller mills comprising:
- a housing;
- a rotating grinding table having a grinding track;
- grinding rollers that roll on the grinding track;
- an axial bearing; and
- a drive having an electric motor and gear reducer for driving the grinding track,
- wherein a continuous availability of at least two drives is provided by the arrangement of more than two drives,
- wherein at least two drives deliver the required grinding output of the roller mill, and
- wherein a crown gear is associated with the grinding table, and wherein each of the drives has one pinion that meshes with the crown gear.

2. The drive system according to claim 1, wherein the pinions are self-adjusting.

3. The drive system according to claim 1, wherein the transmission is a single-stage or multi-stage spur gear reducer.

4. The drive system according to claim 1, wherein the transmission housing has inspection openings for evaluating tooth engagement.

5. The drive system according to claim 1, wherein each drive is mounted on a carriage.

6. The drive system according to claim 1, wherein at least three drives are provided.

7. The drive system according to claim 1, wherein the drives are arranged so that radial forces act on the crown gear as symmetrically as possible.

8. The drive system according to claim 1, wherein the electric motors are asynchronous motors.

9. The drive system according to claim 1, wherein electric motors with high speeds are used.

10. The drive system according to claim 1, wherein the electric motors are mounted vertically.

11. The drive system according to claim 1, wherein a frequency converter is associated with the electric motors for load balancing.

12. The drive system according to claim 11, wherein the frequency converter is organized using a master/slave principle.

13. The drive system according to claim 1, wherein a frequency converter is associated with the electric motors for matching the speed of the grinding track.

14. The drive system according to claim 1, further comprising a highly dynamic control system.

15. A redundant drive system for roller mills comprising:

a housing;

a rotating grinding table having a grinding track;

grinding rollers that roll on the grinding track;

an axial bearing;

wherein more than two drives each having an electric motor and gear reducer are provided to provide continuous availability of at least two drives for collectively and cooperatively driving the grinding table and together providing the required grinding output of said roller mill, wherein each drive need only supply part of the overall drive power required for said roller mill.

16. The drive system according to claim 15, wherein each drive is mounted on a carriage.

17. The drive system according to claim 15, wherein at least three drives are provided.

18. The drive system according to claim 15, wherein a frequency converter is associated with the electric motors for load balancing or matching the speed of the grinding track.

* * * * *